US010670325B2

(12) United States Patent
Zhang et al.

(10) Patent No.: US 10,670,325 B2
(45) Date of Patent: Jun. 2, 2020

(54) REFRIGERATOR AND AIR DOOR DEVICE THEREOF

(71) Applicant: QINGDAO HAIER JOINT STOCK CO., LTD., Qingdao, Shandong Province (CN)

(72) Inventors: Humin Zhang, Qingdao (CN); Hao Zhang, Qingdao (CN); Enpin Xia, Qingdao (CN); Xiaobing Zhu, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 85 days.

(21) Appl. No.: 15/776,408

(22) PCT Filed: Jun. 17, 2016

(86) PCT No.: PCT/CN2016/086183

§ 371 (c)(1),
(2) Date: May 15, 2018

(87) PCT Pub. No.: WO2017/084332

PCT Pub. Date: May 26, 2017

(65) Prior Publication Data

US 2018/0299181 A1 Oct. 18, 2018

(30) Foreign Application Priority Data

Nov. 19, 2015 (CN) ..... 2015 1 0802329

(51) Int. Cl.
*F25D 17/04* (2006.01)
*F25D 17/06* (2006.01)
(Continued)

(52) U.S. Cl.
CPC ..... *F25D 17/045* (2013.01); *F25D 17/065* (2013.01); *F25D 17/08* (2013.01);
(Continued)

(58) Field of Classification Search
CPC ..... F25D 17/045; F25D 17/065; F25D 17/08; F25D 29/005; F25D 2317/063; F25D 2317/062
See application file for complete search history.

(56) References Cited

U.S. PATENT DOCUMENTS

2008/0072966 A1* 3/2008 Akabane ..... F24F 13/1426 137/343

FOREIGN PATENT DOCUMENTS

CN 201251338 Y 6/2009
CN 101603762 A 12/2009
(Continued)

*Primary Examiner* — Elizabeth J Martin
(74) *Attorney, Agent, or Firm* — Cheng-Ju Chiang

(57) ABSTRACT

A refrigerator and an air door device thereof are provided. The air door device comprises: a door frame having a ventilation opening; a door plate pivotably installed to the door frame so as to controllably adjust an opening area of the ventilation opening, a guide post parallel with a pivoting axis of the door plate and extending outwards is provided at one side of the door plate; and a guide plate translatably installed to the door frame and perpendicular to the pivoting axis of the door plate, the guide plate has a guide recess portion to cooperate with the guide post, and an extension direction of the guide recess portion is at a predetermined angle relative to a translation direction of the guide plate so that the guide post slides in the guide recess portion to drive the door plate to rotate when the guide plate is translated.

12 Claims, 2 Drawing Sheets

(51) Int. Cl.
*F25D 17/08* (2006.01)
*F25D 29/00* (2006.01)

(52) U.S. Cl.
CPC ..... *F25D 29/005* (2013.01); *F25D 2317/063* (2013.01); *F25D 2317/0672* (2013.01)

(56) References Cited

FOREIGN PATENT DOCUMENTS

| | | | |
|---|---|---|---|
| CN | 102913102 | A | 2/2013 |
| CN | 103591343 | A | 2/2014 |
| CN | 104296459 | A | 1/2015 |
| CN | 204177014 | U | 2/2015 |
| CN | 104482704 | A | 4/2015 |
| CN | 104613695 | A | 5/2015 |
| CN | 104764270 | A | 7/2015 |
| CN | 204787503 | U | 11/2015 |
| CN | 105371564 | A | 3/2016 |
| CN | 205192040 | U | 4/2016 |
| JP | H1-316578 | A | 12/1989 |
| JP | 2009-30934 | A | 2/2009 |

* cited by examiner

REFRIGERATOR AND AIR DOOR DEVICE THEREOF

CROSS REFERENCE TO RELATED APPLICATIONS

The present application is a 35 U.S.C. § 371 National Phase conversion of International (PCT) Patent Application No. PCT/CN2016/086183, filed on Jun. 17, 2016, which further claims benefit of Chinese Patent Application No. 201510802329.4, filed on Nov. 19, 2015, the disclosure of which is incorporated by reference herein. The PCT International Patent Application was filed and published in Chinese.

FIELD OF THE INVENTION

The present invention relates to a refrigeration device or a freezing device, and in particular, to a refrigerator and an air door device thereof.

BACKGROUND OF THE INVENTION

An air-cooled refrigerator is generally provided with an independent cooling compartment for placing an evaporator, and an air channel at the rear side of a storage compartment to deliver cooling air in the cooling compartment to the storage compartment. An air door is arranged in the air channel for opening or shielding the air channel or adjusting the ventilation area of the air channel so as to adjust the temperature of the storage compartment.

In the prior art, the air door is usually an electric air door, which is accurate in adjustment and high in controllability, but relatively high in cost, complicated in structure and cumbersome in control, and consumes a certain amount of electrical energy during use.

SUMMARY OF THE INVENTION

One objective of the present invention is to solve at least one of the above-mentioned defects in the prior art by providing an air door device which has a simple structure, is convenient to operate, and consumes no electrical energy.

Another objective of the present invention is to provide a refrigerator including the air door device.

According to the first aspect of the present invention, the present invention provides an air door device for a refrigerator. The air door device comprises: a door frame having a ventilation opening; a door plate pivotably installed to the door frame so as to controllably adjust an opening area of the ventilation opening, wherein a guide post parallel with a pivoting axis of the door plate and extending outwards is provided at one side of the door plate; and a guide plate translatably installed to the door frame and perpendicular to the pivoting axis of the door plate, wherein the guide plate has a guide recess portion to cooperate with the guide post, and an extension direction of the guide recess portion is at a predetermined angle relative to a translation direction of the guide plate so that the guide post slides in the guide recess portion to drive the door plate to rotate when the guide plate is translated.

Optionally, the door frame comprises: a base plate having the ventilation opening arranged in its middle portion; and a side edge frame which encloses the outer edges of the base plate to define an accommodation space for accommodating the door plate and which comprises four side edges perpendicular to the base plate respectively.

Optionally, the four side edges comprise a first side edge and a second side edge parallel with each other, the first and second side edges respectively having opposite installation holes for installing pivoting shafts of the door plate; and the guide plate is attached to the outer side of the first side edge.

Optionally, the pivoting shaft of the door plate is located at an edge of the door plate away from the guide post.

Optionally, an outer side surface of the first side edge has a guide groove extending along a predetermined direction; and the guide plate has a guide protrusion protruding towards the guide groove and movably arranged in the guide groove for guiding a translation direction of the guide plate.

Optionally, the guide groove extends along a straight line parallel with a plane in which the ventilation opening is located.

Optionally, the guide recess portion extends along a straight line on the guide plate.

Optionally, a connecting ear-plate, which extends from the surface of the door plate and away from the ventilation opening, is disposed at a side edge of the door plate; and the guide post is fixed at an end of the connecting ear-plate away from the door plate.

Optionally, the guide plate has a handle portion so that a user can hold the handle portion to move the guide plate.

In another aspect, the present invention also provides a refrigerator, comprising a storage compartment, and an air channel configured to deliver cooling air to the storage compartment, and further comprising: at least one of the above air door devices. The door frame and the door plate are disposed in the air channel, so that an opening area of the ventilation opening can be adjusted by rotating the door plate relative to the door frame when the guide plate is moved.

According to the refrigerator and the air door device thereof of the present invention, an opening area of the ventilation opening can be adjusted by pivoting the door plate. In addition, the door frame has a guide plate which can be translated along a predetermined direction; the guide recess portion on the guide plate cooperates with the guide post on the door plate; the extension direction of the guide recess portion is at a predetermined angle relative to the movement direction of the guide plate, so that the door plate can be pivoted when the guide plate is translated. Therefore, the air door device of the present invention is delicate in structure and convenient in adjustment.

Further, according to the air door device of the present invention, the first side edge of the door frame has a guide groove, and the guide plate has a guide protrusion to cooperate with the guide groove, so that cooperation between the guide groove and the guide protrusion can define the guide plate to translate along a predetermined direction only. Further, the handle portion facilitates the user's operations.

The above and other objectives, advantages and features of the present invention will be understood by those skilled in the art more clearly with reference to the detailed description of the specific embodiments of the present invention below in conjunction with the accompanied drawings.

BRIEF DESCRIPTION OF THE DRAWINGS

The followings will describe some specific embodiments of the present invention in detail in an exemplary rather than restrictive manner with reference to the accompanying drawings. The same reference signs in the drawings represent the same or similar parts. Those skilled in the art shall understand that these drawings may not be necessarily drawn according to the scales. In the drawings.

DETAILED DESCRIPTION OF THE EMBODIMENTS

Figure 1:
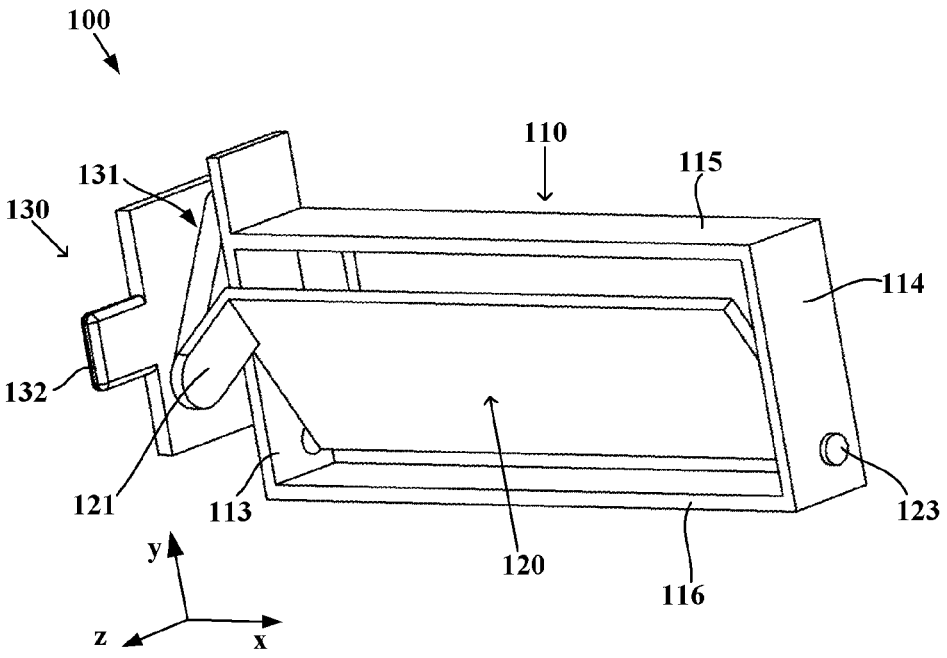
FIG. 1 is a schematic assembly view of an air door device for a refrigerator according to an embodiment of the present invention.
Figure 2:
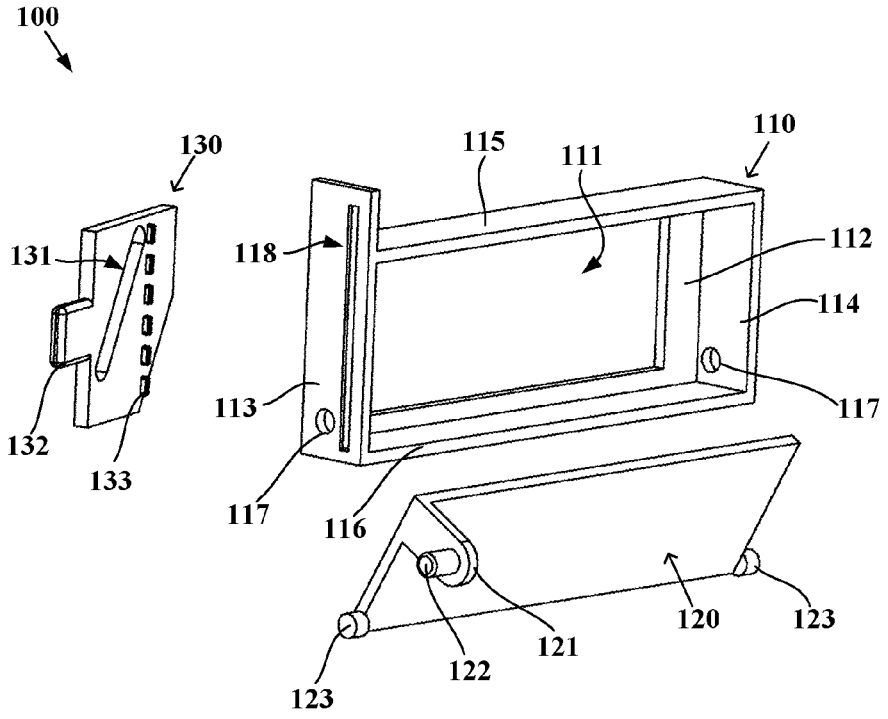
FIG. 2 is an exploded schematic view of the air door device shown in FIG. 1.

FIG. 1 is a schematic assembly view of an air door device for a refrigerator according to an embodiment of the present invention. FIG. 2 is an exploded schematic view of the air door device shown in FIG. 1. As shown in FIGS. 1 and 2, an air door device 100 generally may comprise a door frame 110, a door plate 120 and a guide plate 130. The door frame 110 has a ventilation opening 111. The door plate 120 is pivotably installed to the door frame 110. An opening area of the ventilation opening 111 can be changed by adjusting the pivoting angle of the door plate 120 so as to adjust the flow rate of the cooling air passing through the ventilation opening 111. To realize pivoting movement, a guide post 122 parallel with a pivoting axis (a direction along the x-axis) of the door plate 120 and extending outwards is provided at one side of the door plate 120. The guide plate 130 is translatably installed to the door frame 110 and perpendicular to the pivoting axis of the door plate 120 (parallel with the y-z plane). In addition, the guide plate 130 has a guide recess portion 131 (which may be a through hole or a channel) to cooperate with the guide post 122, and an extension direction of the guide recess portion 131 is at a predetermined angle relative to a translation direction of the guide plate 130 so that the guide post 122 slides in the guide recess portion 131 to drive the door plate 120 to rotate when the guide plate 130 is translated. To realize the above movement process, the predetermined angle should be an acute angle.

Specifically, the door frame 110 may comprise a base plate 112 and a side edge frame. The ventilation opening 111 is arranged at the middle portion of the base plate 112. The side edge frame encloses the outer edges of the base plate 112 to define an accommodation space for accommodating the door plate 120. As shown in FIG. 2, the side edge frame comprises four side edges perpendicular to the base plate 112 (which is parallel with the x-y plane) respectively, including a first side edge 113, a second side edge 114, a third side edge 115 and a fourth side edge 116. The first side edge 113 and the second side edge 114 are parallel with each other (namely, they are parallel with the y-z plane respectively), and respectively have opposite installation holes 117 for installing pivoting shafts 123 of the door plate 120. The guide plate 130 is attached to the outer side of the first side edge 113, and can be translated along the outer side thereof.

In a preferred embodiment, the pivoting shaft 123 of the door plate 120 is located at an edge of the door plate 120 away from the guide post 122. Of course, in other embodiments, the pivoting shaft 123 of the door plate 120 may be arranged at the intermediate edge of the door plate 120; that is, the pivoting axis of the door plate 120 is located at a center line of the door plate 120 (not shown in the drawings).

To restrict the translation of the door plate 120 so that the door plate 120 can only move along a predetermined direction, an outer side surface of the first side edge 113 has a guide groove 118 extending along a predetermined direction. In addition, the guide plate 130 may have a guide protrusion 133 protruding towards the guide groove 118 and movably arranged in the guide groove 118. The guide protrusion 133 may be a continuous protruding strip or non-continuous multiple protruding strips (as shown in FIG. 2), so long as the translation direction of the door plate 120 can be reasonably defined. To facilitate adjustment, the extension direction of the guide groove 118 is a straight line, and is parallel with the plane where the ventilation opening 111 is located (or along the y-axis direction). Further, the guide recess portion 131 on the guide plate 130 may also extend along a straight line.

As shown in FIGS. 1 and 2, a connecting ear-plate 121, which extends from the surface of the door plate 120 and away from the ventilation opening 111, is disposed at a side edge of the door plate 120, and the guide post 122 is fixed at an end of the connecting ear-plate 121 away from the door plate 120, so that the guide post 122 can be prevented from colliding with the first side edge 113 when the door plate 120 closes the ventilation opening 111.

In some embodiments, the guide plate 130 has a handle portion 132 so that a user can hold the handle portion 132 to move the guide plate 130.

Figure 3:
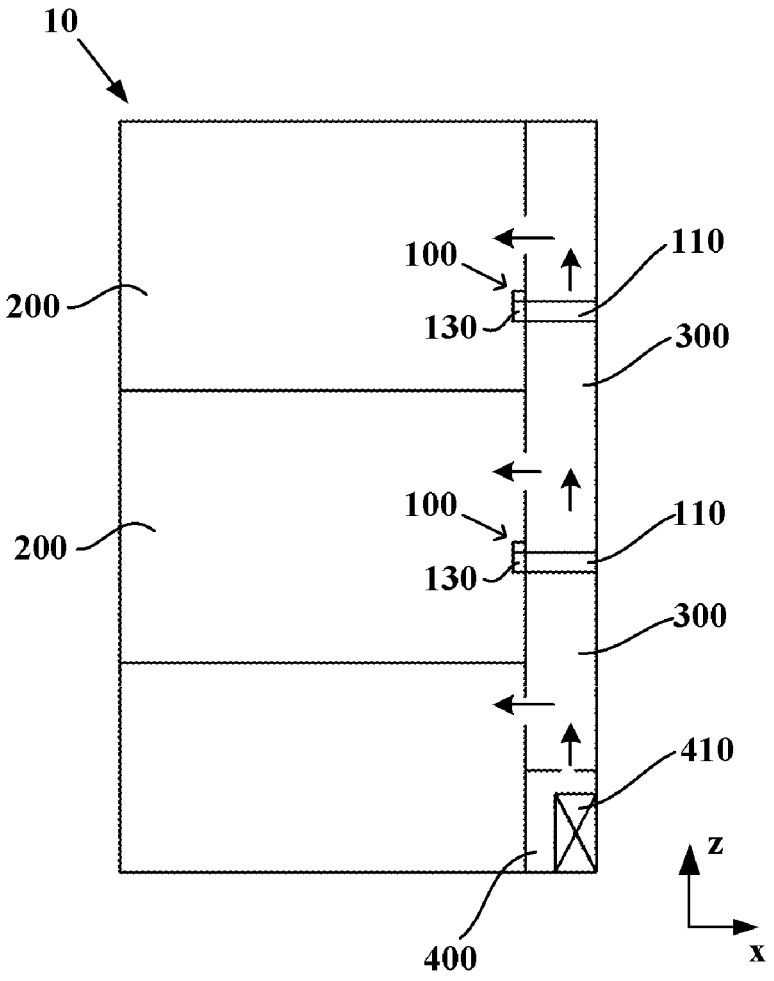
FIG. 3 is a side sectional view of the refrigerator according to an embodiment of the present invention.

FIG. 3 is a side sectional view of the refrigerator according to an embodiment of the present invention. As shown in FIGS. 1-3, the refrigerator 10 comprises multiple storage compartments 200 and a cooling compartment 400 which is arranged at the bottom of the refrigerator 10. An evaporator 410 is arranged inside the cooling compartment 400. An air channel 300 communicates with the cooling compartment 400 and the respective storage compartments 200 so as to controllably deliver cooling air prepared by the cooling compartment 400 to the respective storage compartments 200. The above air door device 100 is arranged in the air channel 300. The door frame 110 and the door plate 120 are arranged inside the air channel 300. The guide plate 130 is arranged at the outer side of the front wall of the air channel 300, or is located in a storage compartment 200. When the user moves the guide plate 130, the door plate 120 is pivoted relative to the door frame 110 to adjust the opening area of the ventilation opening 111, whereby the flow rate of the cooling air entering the storage compartment 200 is changed to adjust the temperature in the storage compartment 200.

The specific position of the air door device 100 can be determined based on the extension direction of the air channel 300. In the embodiment shown in FIG. 3, the air channel 300 is arranged vertically at the rear side of the refrigerator 10, and the pivoting axis of the door plate 120 may be arranged along the front-rear direction of the refrigerator 10. In other words, as shown in FIG. 3, the positive part of the x-axis may be arranged at the rear side, and the positive part of the z-axis may face upwards. The positive part of the y-axis may be face inwards and may be perpendicular to the paper showing FIG. 3, which is not shown in FIG. 3. The user may operate the handle portion 132 to move the guide plate 130 along the y-axis (or perpendicularly to the paper showing FIG. 3), so that the door plate 120 can change the opening area of the ventilation opening 111 in a pivoting manner.

Therefore, those skilled in the art should realize that although multiple exemplary embodiments of the present invention have been illustrated and described in detail, many other variations or modifications that accord with the principle of the present invention may be still determined or derived directly from the content disclosed by the present invention without departing from the spirit and scope of the present invention. Thus, the scope of the present invention should be understood and deemed to include these and other variations or modifications.

What is claimed is:

1. An air door device for a refrigerator, comprising:

a door frame having a ventilation opening;

a door plate pivotably installed to the door frame so as to controllably adjust an opening area of the ventilation opening, wherein a guide post parallel with a pivoting axis of the door plate and extending outwards is provided at one side of the door plate;

a guide plate translatably installed to the door frame and perpendicular to the pivoting axis of the door plate, wherein the guide plate has a guide recess portion to cooperate with the guide post, and an extension direction of the guide recess portion is at a predetermined angle relative to a translation direction of the guide plate so that the guide post slides in the guide recess portion to drive the door plate to rotate when the guide plate is translated, the translational direction of the guide plate is parallel with a plane in which the ventilation opening is located;

wherein the door frame comprise a base plate and a side edge frame, the base plate having the ventilation opening arranged in its middle portion, the side edge frame which encloses the outer edges of the base plate to define an accommodation space for accommodating the door plate, the side edge frame comprises four side edges perpendicular to the base plate respectively, the four side edges comprise a first side edge and a second side edge parallel with each other, and respectively having opposite installation holes for installing pivoting shafts of the door plate, the guide plate is attached to the outer side of the first side edge;

wherein a connecting ear-plate, which extends from the surface of the door plate and away from the ventilation opening, is disposed at a side edge of the door plate; and the guide post is fixed at an end of the connecting ear-plate away from the door plate.

2. The air door device according to claim 1, wherein the pivoting shaft of the door plate is located at an edge of the door plate away from the guide post.

3. The air door device according to claim 1, wherein an outer side surface of the first side edge has a guide groove extending along a predetermined direction; and the guide plate has a guide protrusion protruding towards the guide groove and movably arranged in the guide groove for guiding a translation direction of the guide plate.

4. The air door device according to claim 3, wherein the guide groove extends along a straight line parallel with a plane in which the ventilation opening is located.

5. The air door device according to claim 4, wherein the guide recess portion extends along a straight line on the guide plate.

6. The air door device according to claim 1, wherein the guide plate has a handle portion so that a user can hold the handle portion to move the guide plate.

7. A refrigerator, comprising a storage compartment, and an air channel configured to deliver cooling air to the storage compartment, and further comprising:

at least one air door device according to claim 1, wherein the door frame and the door plate are disposed in the air channel, so that an opening area of the ventilation opening can be adjusted by rotating the door plate relative to the door frame when the guide plate is moved.

8. The refrigerator according to claim 7, wherein the pivoting shaft of the door plate is located at an edge of the door plate away from the guide post.

9. The refrigerator according to claim 7, wherein an outer side surface of the first side edge has a guide groove extending along a predetermined direction; and the guide plate has a guide protrusion protruding towards the guide groove and movably arranged in the guide groove for guiding a translation direction of the guide plate.

10. The refrigerator according to claim 9, wherein the guide groove extends along a straight line parallel with a plane in which the ventilation opening is located.

11. The refrigerator according to claim 10, wherein the guide recess portion extends along a straight line on the guide plate.

12. The refrigerator according to claim 7, wherein the guide plate has a handle portion so that a user can hold the handle portion to move the guide plate.

* * * * *